US006822540B2

(12) United States Patent
Impio

(10) Patent No.: US 6,822,540 B2
(45) Date of Patent: Nov. 23, 2004

(54) TUNING A CAVITY FILTER BASED ON POSITIONAL DATA FOR TUNING MEMBERS

(75) Inventor: Hannu K. Impio, Oulu (FI)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 10/061,842

(22) Filed: Oct. 26, 2001

(65) Prior Publication Data

US 2003/0083027 A1 May 1, 2003

(51) Int. Cl.[7] ..... H01P 7/06
(52) U.S. Cl. ..... 333/232; 333/17.1; 333/235
(58) Field of Search ..... 333/17.1, 231, 333/232, 235, 223, 224, 225, 226

(56) References Cited

U.S. PATENT DOCUMENTS 4,028,652 A * 6/1977 Wakino et al. ..... 333/219.1
5,235,294 A * 8/1993 Ishikawa et al. ..... 333/17.1
6,147,577 A * 11/2000 Cavey ..... 333/209

* cited by examiner

*Primary Examiner*—Stephen E. Jones
(74) *Attorney, Agent, or Firm*—Fogg & Associates, LLC; Scott V. Lundberg

(57) ABSTRACT

A method for tuning a cavity filter is provided. The cavity filter includes a plurality of tuning members. The method includes selecting a stored set of positional values for the tuning members, driving the tuning members of the cavity filter to the stored set of positional values, and further adjusting the position of the tuning members as necessary to achieve a desired frequency response for the cavity filter.

34 Claims, 10 Drawing Sheets

TUNING A CAVITY FILTER BASED ON POSITIONAL DATA FOR TUNING MEMBERS

TECHNICAL FIELD

The present invention relates generally to the field of telecommunications and, in particular, to a technique for tuning a cavity filter based on position measurements for tuning members.

BACKGROUND

Wireless telecommunications systems transmit signals between users using radio frequency (RF) signals. A typical wireless system includes a plurality of base stations that are connected to the public switched telephone network (PSTN) via a mobile switching center (MSC). Each base station includes a number of radio transceivers that are typically associated with a transmission tower. Each base station is located so as to cover a geographic region known colloquially as a "cell." Each base station communicates with wireless terminals, e.g. cellular telephones, pagers, and other wireless units, located in its geographic region or cell.

A wireless base station includes a number of modules that process RF signals. These modules typically include, by way of example, mixers, amplifiers, filters, transmission lines, antennas and other appropriate circuits. One type of filter that finds increased use in wireless base stations is known as a cavity filter.

Cavity filters typically include a plurality of resonators located in a housing. The frequency response of each resonator is adjusted using a tuning member, e.g., a tuning screw, that extends through a plate of the housing into the cavity of the resonator. A group of resonators coupled in series form a filter with a specified overall frequency response.

During manufacturing, each filter is tuned to provide the specified frequency response. A technician tunes the filter by adjusting the position of the tuning members in the plate for each resonator of the filter in an iterative process until the correct frequency response is achieved. This can be a tedious and time-consuming process. Further, the process is labor intensive and relies on the ability of skilled artisans to accomplish the desired tuning in a reasonable amount of time. It can take years for a technician to reach a productive level of skill in tuning these filters. Moreover, the process often requires design and use of various mechanical jigs. Finally, filters are tuned on a one-by-one basis when fully assembled.

For the reasons stated above, and for other reasons stated below which will become apparent to those skilled in the art upon reading and understanding the present specification, there is a need in the art for a technique for tuning filters in a less labor intensive manner.

SUMMARY

The above mentioned problems with tuning cavity filters and other problems are addressed by embodiments of the present invention and will be understood by reading and studying the following specification. Embodiments of the present invention provide for pre-tuning a cavity filter using measured positional data for a plurality of tuning members of a tuned cavity filter. Advantageously, embodiments of the present invention allow a low-skilled technician to pre-tune an assembled cavity filter within a close approximation of a desired frequency response in a short period of time without the use of costly, complex mechanical jigs, and without monitoring signals processed by the filter.

In one embodiment, a method for tuning a cavity filter is provided. The cavity filter includes a plurality of tuning members. The method includes selecting a stored set of positional values for the tuning members, driving the tuning members of the cavity filter to the stored set of positional values, and further adjusting the position of the tuning members as necessary to achieve a desired frequency response for the cavity filter.

DETAILED DESCRIPTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense.

Embodiments of the present invention provide improvements in the tuning of cavity filters. In some embodiments, a tool is used to measure the position of tuning members of a tuned cavity filter. These measured positions are stored for use in pre-tuning additional cavity filters. In one embodiment, the tool is a power screwdriver that is modified with a depth measuring unit and a controller. The tool is adapted to drive the tuning members of the cavity filter to the selected depths in a wall of the cavity filter as measured by the depth measuring unit and controlled by the controller. Further, the tool also is adapted to determine the depth of tuning members in a wall of the cavity filter.

I. First Embodiment

A. Tool

Figure 1:
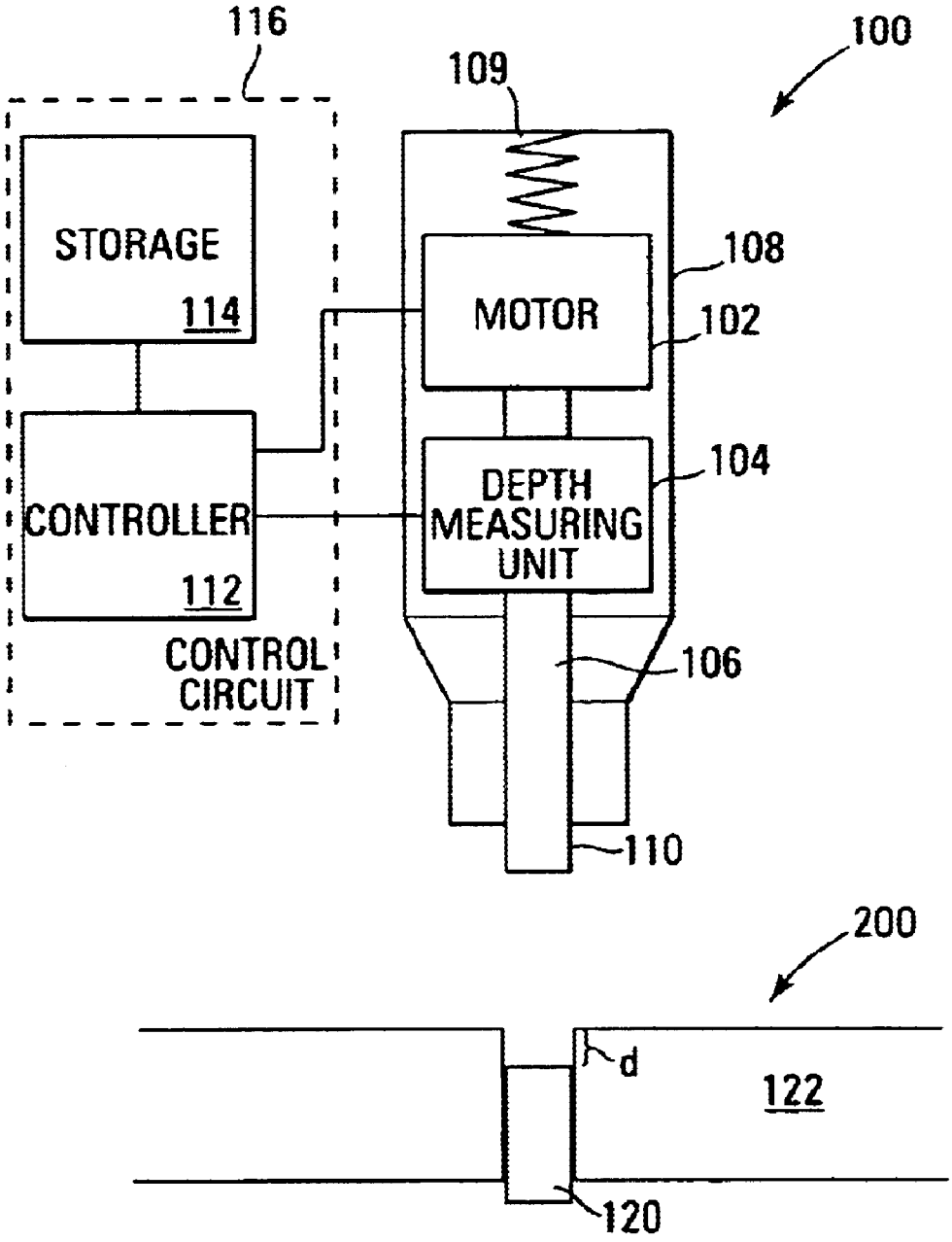
FIG. 1 is a schematic diagram of one embodiment of a tool for tuning a cavity filter shown in partial cross-section according to the teachings of the present invention.

FIG. 1 is a schematic diagram of one embodiment of a tool, indicated at an 100, for tuning a cavity filter, indicated at 200, shown in partial cross-section according to the teachings of the present invention. Tool 100 performs two main functions. First, tool 100 measures the position of tuning members in a tuned cavity filter. Further, tool 100 uses known positional values for tuning members to pre-tune an un-tuned cavity filter. Tool 100 includes control circuit 116 and housing 108. The structure and operation of each of these components of tool 100 is discussed in turn below. Further, although the control circuit 116 is shown separate from housing 108, it is understood that control circuit 116, in other embodiments, is incorporated within housing 108.

Housing 108 houses motor 102, depth measuring unit 104, and shaft 106. Motor 102 is coupled to drive shaft 106 to control the depth of tuning members, e.g., tuning member 120, in plate 122 of cavity filter 200 during operation of tool 100. Tool 100 further includes spring 109. Spring 109 biases the assembly of motor 102, depth measuring unit 104 and shaft 106 in housing 108. With no external force exerted on tip 110 of shaft 106, spring 109 forces shaft 106 at tip 110 to extend from housing 108. In this embodiment, the entire assembly of motor 102 and shaft 106 is adapted to move in and out of housing 108 during measuring the position of tuning members in a tuned filter and during positioning of tuning members in an un-tuned housing.

Depth measuring unit 104, in one embodiment, is positioned to monitor the movement and position of the assembly of shaft 106 and motor 102 in housing 108. In one embodiment, depth measuring unit 104 comprises a digital caliper such as digital caliper model No. CD-15DC available from Mitutoyo of Japan or other appropriate measuring device. In another embodiment, depth measuring unit 104 comprises a sliding gauge. Depth measuring unit 104 is adapted to determine the extent to which shaft 106 and motor 102 move to extend tip 110 from housing 108. This distance is related to the distance, d, that tuning member 120 is driven into plate 122. Thus, by measuring the distance that tip 110 extends from housing 108 using distance measuring unit 104, tool 100 determines a positional value for tuning member 120. This measurement is used in both determining positional values for tuning members in a tuned filter and in pre-tuning an un-tuned filter as described in more detail below with respect to FIGS. 2–5.

Control circuit 116 controls the operation of tool 100. Control circuit 116 includes controller 112 and storage 114. In one embodiment, storage 114 comprises a disk drive, flash memory, server, or other appropriate storage medium for storing the positional data for a plurality of tuning members. In one embodiment, controller 112 comprises a programmed computer. In other embodiments, controller 112 is a dedicated device that is optionally connected to and controlled by a computer.

Controller 112 receives user inputs to perform two main operations: measuring the position of tuning members in a tuned filter and setting the position of tuning members in a filter to be pre-tuned. In one embodiment of the measuring operation, controller 112 receives a first input to initiate the measuring process and a second input to save the measured value from depth measuring unit 104 to storage 114. In one embodiment of the position setting operation, controller 112 receives inputs that identify the tuning member so that the appropriate positional value is retrieved and an initiation input to start the process of driving the tuning member to the retrieved positional value. In both operations, controller 112 also receives an input from depth measuring device that is related to the distance, d, indicated in FIG. 1. Other appropriate input signals may also be provided to controller 112.

In one embodiment, the inputs to controller 112 are placed on housing 108. In other embodiments, the inputs are incorporated in control circuit 116 or a separate device.

The two operational modes of tool 100 are discussed in turn below. First, the measurement mode of operation is described with respect to FIGS. 2 and 3. Next, the positional setting mode is described with respect to FIGS. 4 and 5.

B. Measurement Mode

Figure 2:
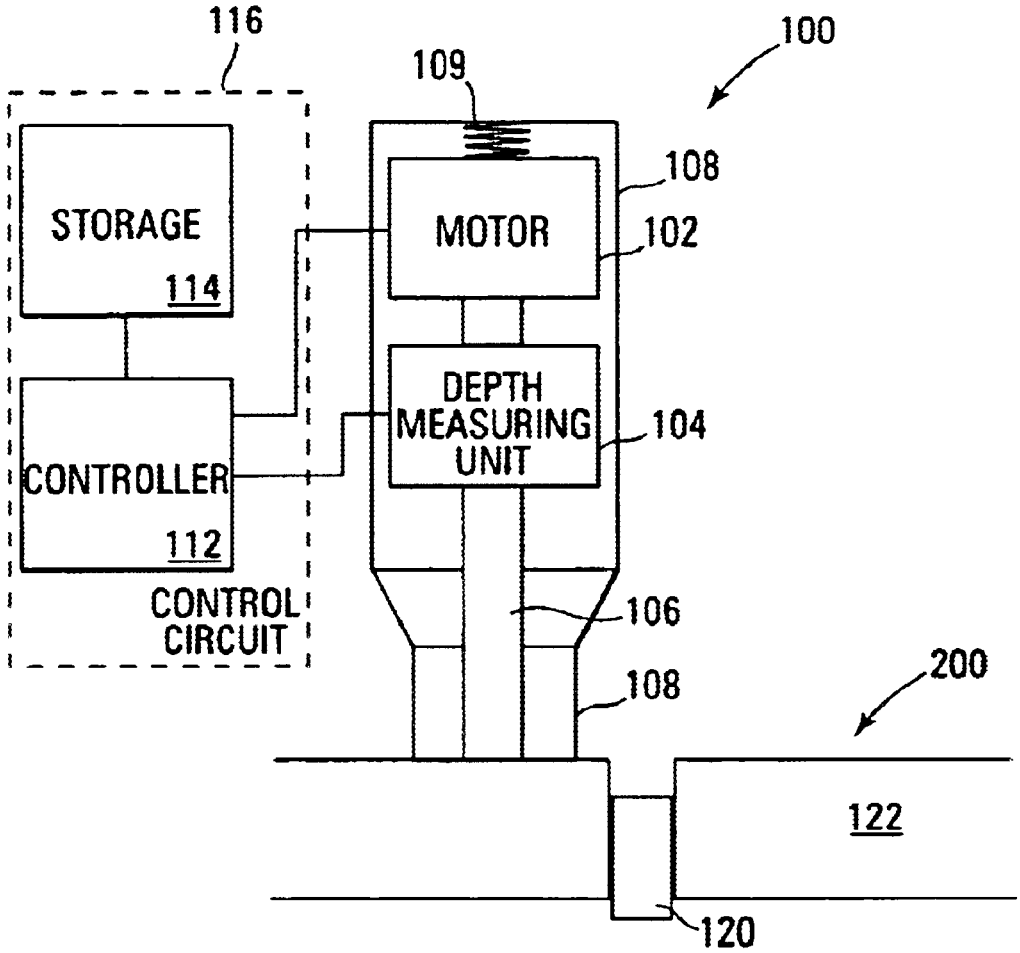
FIGS. 2 and 3 are elevational views of a process for measuring the position of tuning members of a cavity filter according to one embodiment of the present invention.
Figure 3:
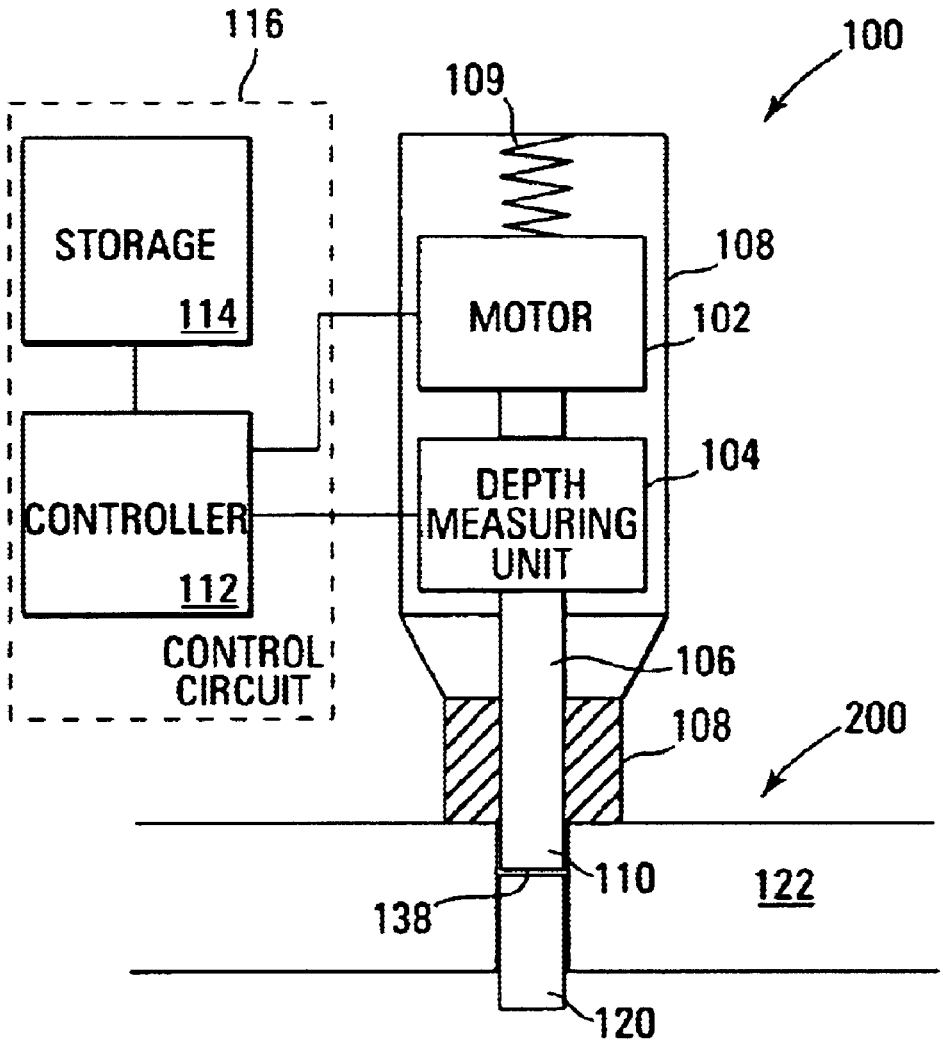

FIGS. 2 and 3 are elevational views of a process for measuring the position of tuning members of a cavity filter according to one embodiment of the present invention. In this process, tool 100 is brought into contact with plate 122 such that tip 110 of shaft 106 is flush with an end of housing 108. An input is provided at this point to indicate that the tip is in the "zero" or initial position so that a relative measurement can be computed once top 110 moves into engagement with tuning member 120.

Tool 100 is then moved over tuning member 120. Once in place, spring 109 forces shaft 106 out until tip 110 engages tuning member 120 as shown in FIG. 3. With shaft 106 extended, tool 100 is ready to capture the measurement. In response to user input, controller 112 captures the output of depth measuring unit 104 and computes a positional value to be stored in a database in storage 114. In one embodiment, this process is repeated for each of the tuning members of the cavity filter. Once all of the positional data is stored, the positional data can be used for pre-tuning a large number of un-tuned cavity filters using the process described below with respect to FIGS. 4 and 5. In another embodiment, the process of measuring positional data of tuning members is conducted for a plurality of tuned filters and, for example, an average of the positional values for the filters is used to pre-tune other filters. Further, in one embodiment, the collected positional data can also be used to control the repeatability of the tuning process.

In one embodiment, shaft 106 has two configurations for tip 110. The first configuration is used in the measurement mode. In this configuration, tip 110 has a flat surface 138 for engaging a top of tuning member 120. In this manner, it is not necessary to line up the screwdriver mechanism of tip 110 with a slot or other receptacle of tuning member 120. Surface 138 simply rests on tuning member 120 and provides an accurate measure of the distance, d. The second configuration for tip 110 includes a screwdriver mechanism extending from surface 138 and is used in the position setting mode of operation.

C. Positional Setting Mode

Figure 4:
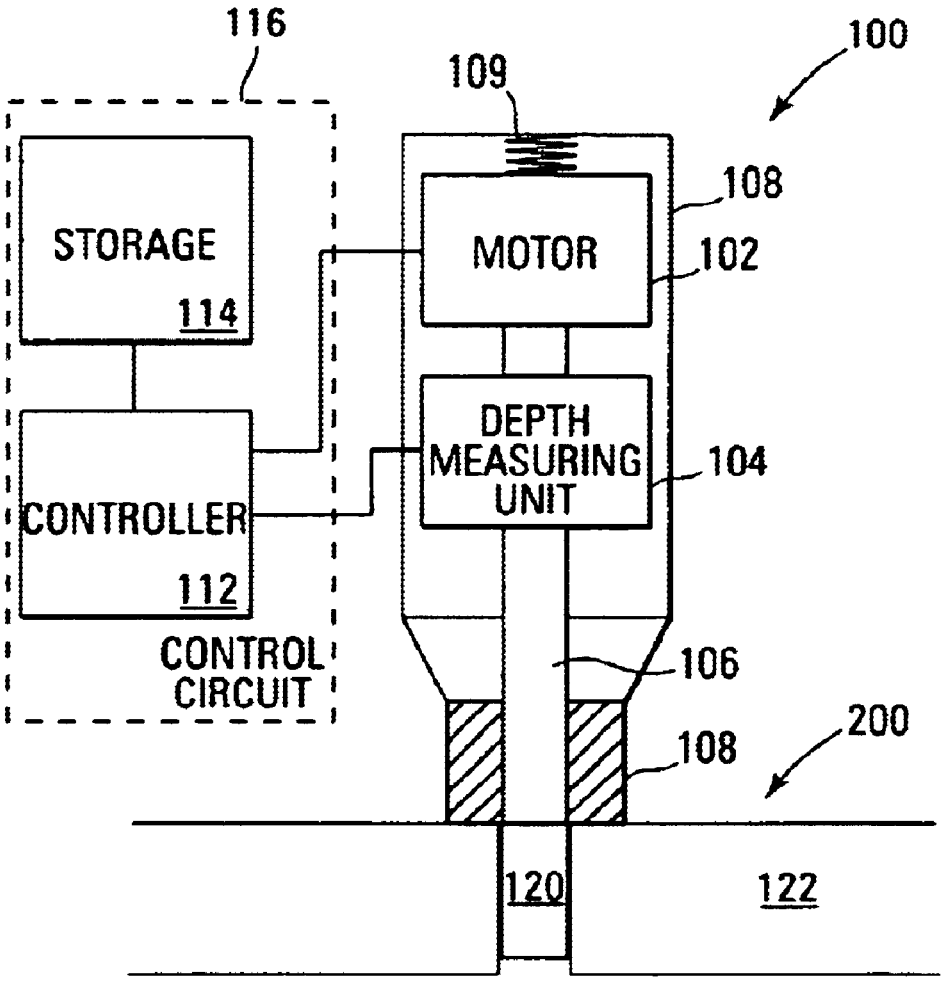
FIGS. 4 and 5 are elevational views of a process for pre-tuning a cavity filter according to one embodiment of the present invention.
Figure 5:
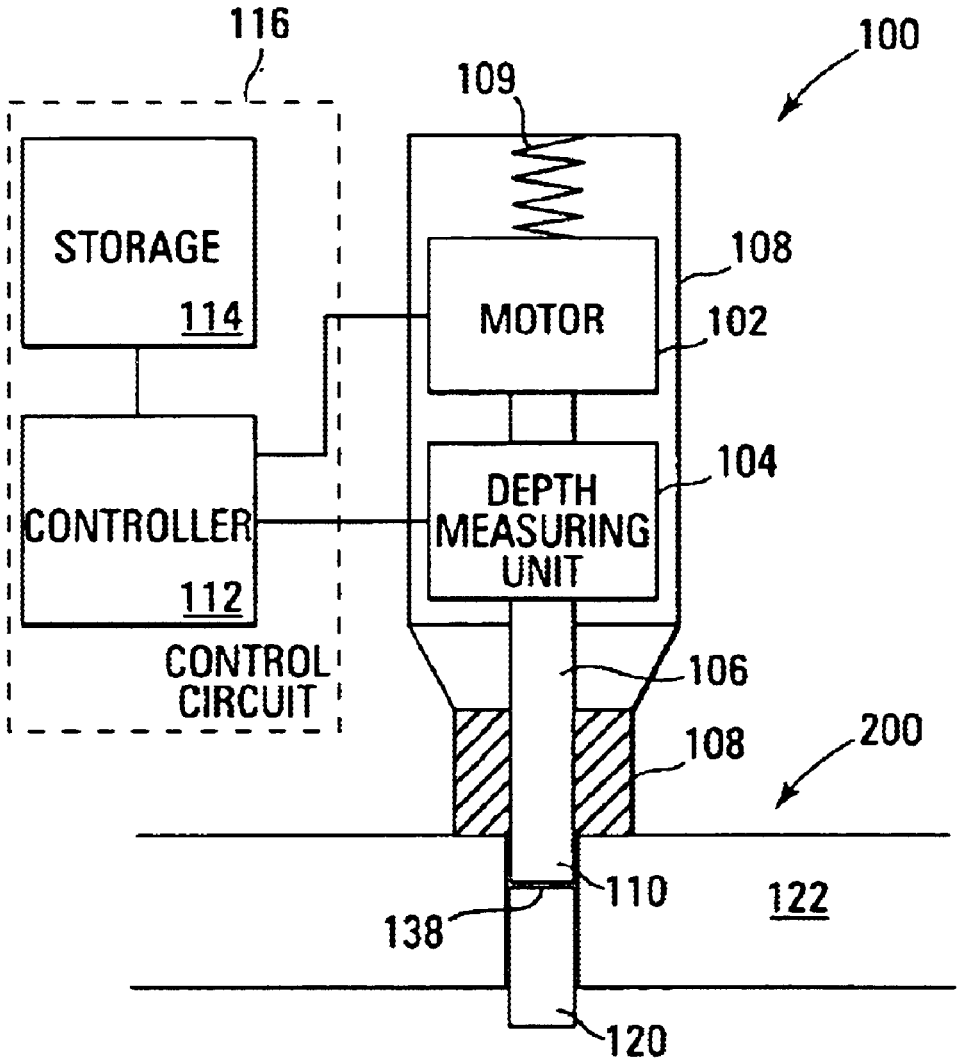

FIGS. 4 and 5 are elevational views of a process for pre-tuning a cavity filter according to one embodiment of the present invention. Initially, tool 100 is placed in contact with a top surface of plate 122 over tuning member 120. Tip 110 of shaft 106 includes the screw driver mechanism and rests within the slot or receptacle of tuning member 120. Tool 100 is set such that the position shown in FIG. 4 is determined to be the "zero" position for determining the relative displacement of shaft 106. Upon a signal from the user, controller 112 causes motor 102 to drive shaft 106 and tip 110 such that tuning member 120 is lowered into plate 122. Spring 109 forces shaft 106 and motor 102 to move in concert with tuning member 120. Controller 112 monitors the depth of tuning member 120 using the output of depth measuring unit 104.

Controller 112 further compares the measured depth with a target depth for the selected tuning member. When the target depth is reached, controller 112 causes motor 102 to stop thereby leaving tuning member 120 at the appropriate depth. Each tuning member is adjusted in turn until all tuning members are placed at their respective stored positions.

Once a cavity filter is pre-tuned, a technician makes any necessary changes to the positions of the tuning members to achieve the desired frequency response. For example, the technician monitors the frequency response of the filter and adjusts the position of tuning members until the observed frequency response is substantially close to the desired frequency response. Advantageously, since the pre-tuning process places the tuning members in the same position as tuning members of a tuned filter, it is possible that the technician will not have to make any changes to the pre-tuned positions of the tuning members. However, due to variations in construction from filter-to-filter, it is expected that a technician will often be needed to make minor changes to the position of one or more tuning members to bring the filter to a final, tuned state. Advantageously, this process is much quicker than conventional approaches because tool 100 places the tuning members in the same position as a known, tuned filter.

It is understood that during a production shift, variations in the processing of the filters may require changes in the stored positional values. When the time required for achieving a final tuned filter becomes excessive, the technician can measure positional values again and store a new set of values to be used in further production.

II. Second Embodiment

Figure 6:
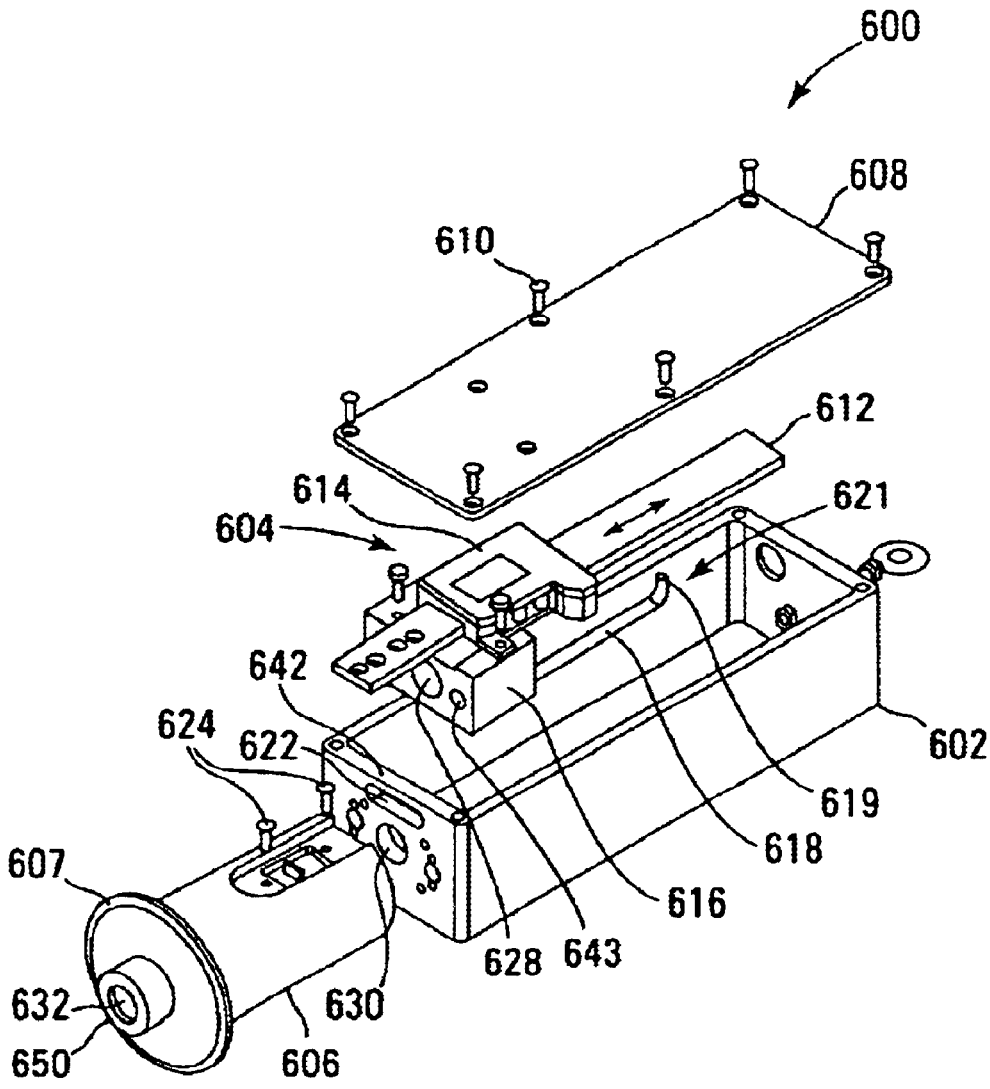
FIG. 6 is an exploded view of a portion of an embodiment of a tool for tuning a cavity filter according to the teachings of the present invention.

FIG. 6 is an exploded perspective view of another embodiment of a tool, indicated at 600, for tuning a cavity filter, such as cavity filter 200 of FIG. 1. In this embodiment, the control circuitry has been omitted for sake of clarity. It is understood that tool 600 is controlled by circuitry similar to the control circuitry described above with respect to FIGS. 1–5. In other embodiments, other appropriate control circuitry is used. Tool 600 includes a housing 602, a depth measuring unit 604, disposed within housing 602, and a handle 606 that is secured to housing 602 by screwing, bolting, or the like. In one embodiment, handle 606 includes a flange 607. A cover 608 closes housing 602 and is secured to housing 602 by a number of fasteners 610, e.g., slot-, hex, square-, Allen-, Phillips-head screws or the like.

Figure 7:
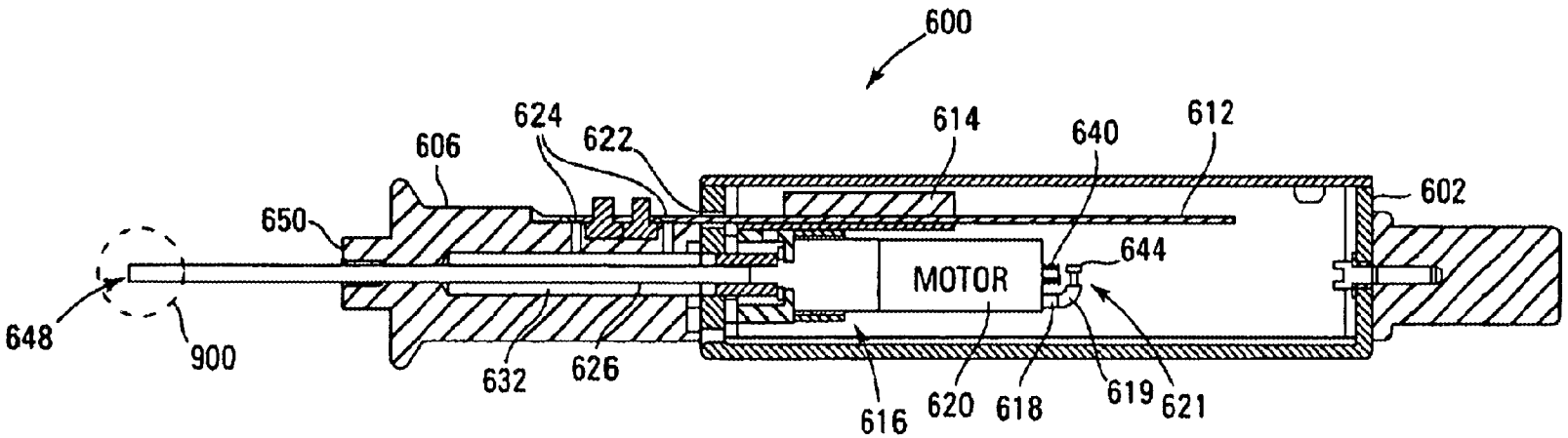
FIG. 7 is a cross sectional, elevational view of the tool of FIG. 6.
Figure 8:
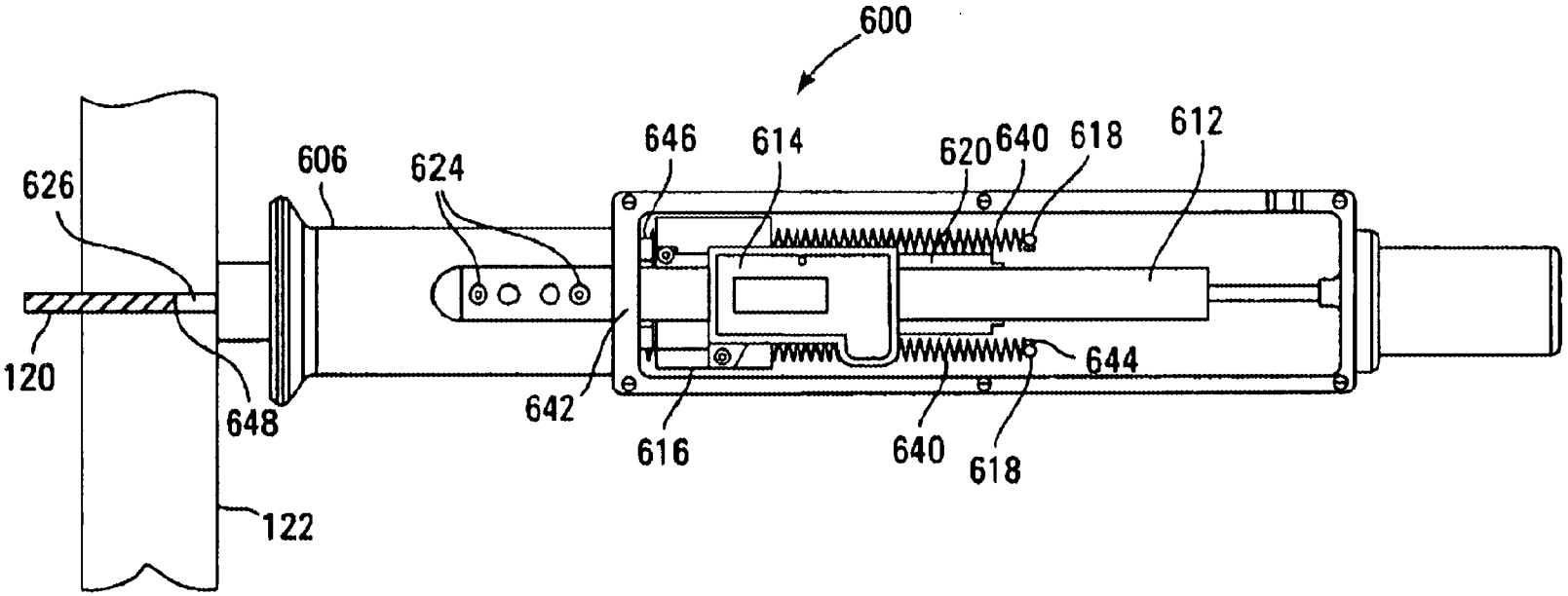
FIG. 8 is a top view of the tool of FIG. 6 engaging a tuning member.

Depth measuring unit 604 includes a rail 612. A measurement head 614 is slidably attached to rail 612. Measurement head 614 is adapted, using methods known to those skilled in the art, to measure the distance that measurement head 614 slides relative to rail 612. In one embodiment, rail 612 and measurement head 614 are a modified caliper rule available from Mitutoyo as model CD-15DC. A block 616 is fixedly attached to measurement head 614 by screwing, bolting, or the like. A motor 620 is fixed to block 616, as shown in FIG. 7, a side view of FIG. 6, by screwing, bolting, or the like. When measurement head 614 slides relative to rail 612, measurement head 614 carries block 616 and motor 620. Rods 618 protrude from block 616 so that each of rods 618 is substantially parallel to rail 612, as shown in FIG. 8, a top view FIG. 6. FIG. 8 illustrates that each of rods 618 is located on either side of rail 612. In one embodiment, each of rods 618 has a hook 619 at an end 621 opposite block 616, as shown in FIGS. 6 and 7.

When depth measuring unit 604 is disposed in housing 602, rail 612 passes through an aperture 622 in housing 602 and is secured to handle 606 by fasteners 624, as shown in FIGS. 7 and 8. In one embodiment, fasteners 624 are slot-, hex-, square-, Allen-, Phillips-head screws or the like. Moreover, a shaft 626 is attached to motor 620 for rotation by motor 620. Shaft 626 passes through an aperture 628 (shown in FIG. 6) in block 616, an aperture 630 (shown in FIG. 6) in housing 602, and a channel 632 in handle 606 (shown in FIGS. 6 and 7). The combination of shaft 626, block 616, and motor 620 comprises one embodiment of a "shaft assembly." This shaft assembly is adapted to adjust and to monitor the position of tuning members in a plate of a cavity filter.

Springs 640 are disposed between end 621 of each of rods 618 and a wall 642 of housing 602, as shown in FIG. 8, to provide for movement of the shaft assembly within housing 602. Springs 640 respectively pass through apertures 643 in block 616, one of which is shown in FIG. 6. In particular, an end 644 of each of springs 640 is attached to hook 619 of each of rods 618, e.g., by hooking, as illustrated in FIG. 7, and an end 646 of each of springs 640 is attached to wall 642, e.g., by welding, bolting, or the like. In one embodiment, sufficient clearance is provided between apertures 643 and the respective springs 640 so that block 616 can move relative to springs 640. Springs 640 bias block 616, in one embodiment, so that block 616 abuts wall 642 unless external pressure is exerted on end 648 of shaft 626. In this position, end 648 of shaft 626 is fully extended beyond end 650 of handle 606. Moreover, springs 640 spring load the shaft assembly, including shaft 626.

Figure 9:
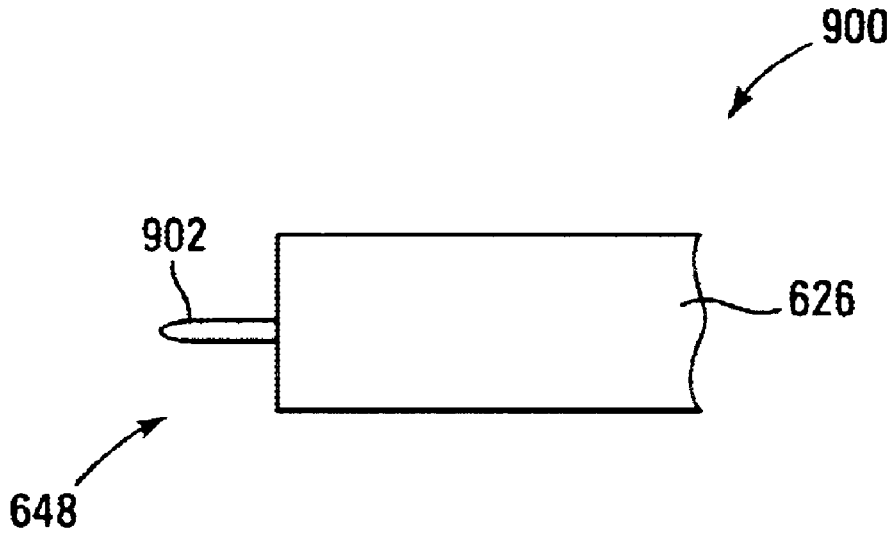
FIGS. 9 and 10 are side views of embodiments of the end of a shaft for a tool of FIG. 6.
Figure 10:
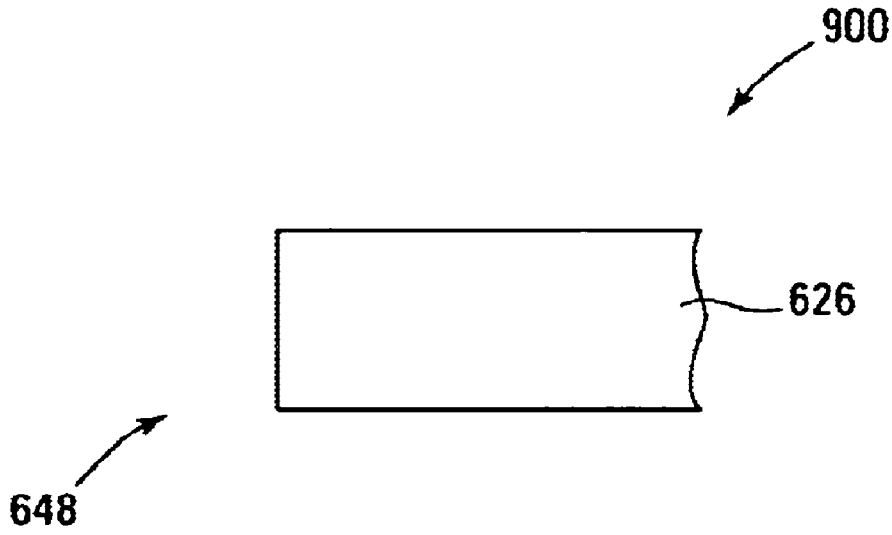

FIGS. 9 and 10 are enlarged views of region 900 of FIG. 7 and respectively illustrate different embodiments of shaft 626. In one embodiment, as illustrated in FIG. 9, shaft 626 includes a protrusion 902 at end 648. In some embodiments, protrusion 902 is for engaging a head of a slot-, Phillips-, or Allen-head screw, or the like. In another embodiment, end 648 is flat, as illustrated in FIG. 10.

Figure 11:
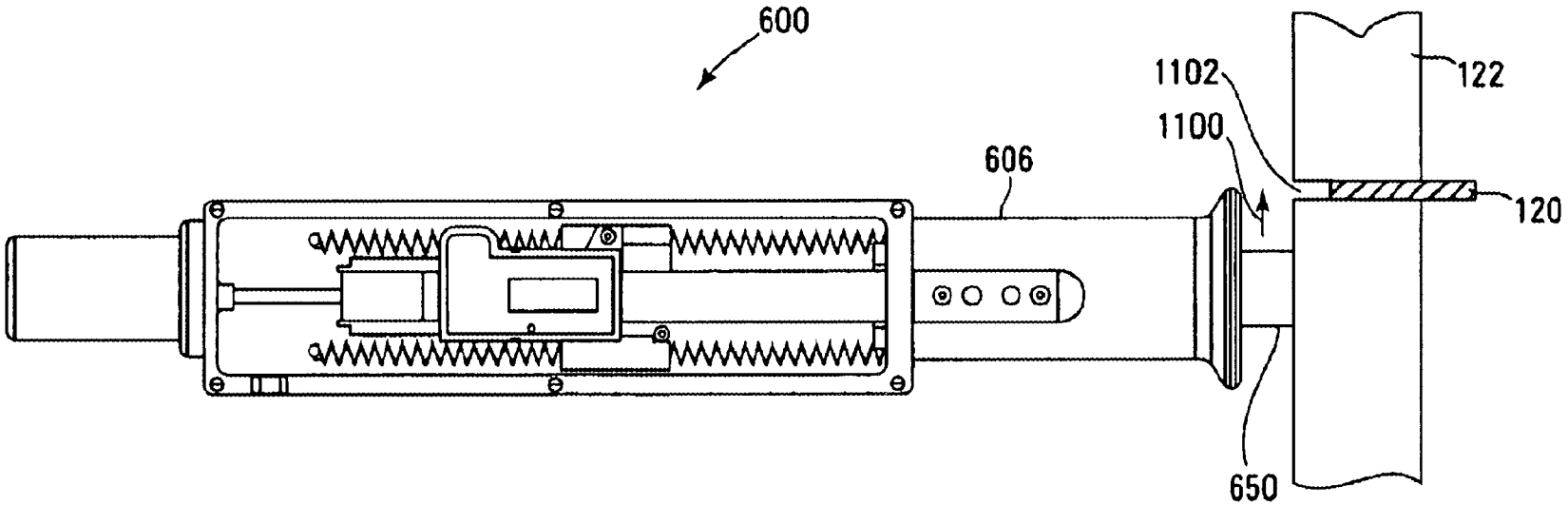
FIG. 11 is a top view of the tool of FIG. 6 in an initial position prior to engaging a tuning member.

In an embodiment of a measurement mode of operation of tool 600, end 648, e.g., the flat end of FIG. 10, of shaft 626 is brought into contact with plate 122 of resonant cavity 200. A force is applied to handle 606 in the direction of plate 122. This causes shaft 626 to impart a force to block 616, which in turn causes measurement head 614 to slide relative to rail 612. As head 614 slides, shaft 626 moves into handle 606 and springs 640 extend. As shaft 626 moves into handle 606, end 650 moves toward plate 122 until end 648 of shaft 626 is flush with end 650 of handle 606. At this point, end 650 abuts plate 122, as shown in FIG. 11. This establishes a reference location for head 614 from which measurements are made.

In one embodiment, shaft 626 is placed in recess 1102. In another embodiment, tool 600 is then moved so that end 650 of handle 606 slides over plate 122 in the direction of arrow 1100. As tool 600 is moved a force is maintained on handle 606 in the direction of plate 122 to keep end 650 in contact with plate 122. This causes plate 122 to exert a force on end 648 of shaft 626 and thus against springs 640. Tool 600 is moved until shaft 626 aligns with recess 102 that occurs between plate 122 and tuning member 120. When shaft 626 aligns with recess 1102, the force exerted on end 648 of shaft 626 is removed and springs 640 are free to pull against block 616, thus causing measurement head 614 to slide relative to rail 612. This causes shaft 626 to move into recess 1102 until it contacts tuning member 120, as shown in FIG. 8. The distance moved by shaft 626 from plate 122 to tuning member 120 is equal to the distance that measurement head 614 slides relative to rail 612. Measurement head 614 thereby measures the distance between plate 122 and tuning element 120 by determining the distance moved from the reference location.

In an embodiment of a positional setting mode of operation, tuning element 120 is flush with plate 122, as described above. This establishes a reference location for head 614 from which measurements are made. Then, protrusion 902 (shown in FIG. 9) of shaft 626 is brought into engagement with tuning element 120, and end 650 of handle 606 is butted against plate 122 as described above. Then, motor 620 is activated and rotates shaft 626, thus screwing tuning element 120 into plate 122, as shown in FIG. 8. As tuning element 120 screws into plate 122, springs 640 pull against block 616, thus causing measurement head 614 to slide relative to rail 612 and shaft 626 to move into the region previously occupied by tuning element 120, as shown in FIG. 8. When head 614 has moved a predetermined distance based on positional data as measured by measurement head 614 from the reference location, a controller, such as controller 112, instructs motor 620 to stop.

Although specific embodiments have been illustrated and described in this specification, it will be appreciated by those of ordinary skill in the art that any id arrangement that is calculated to achieve the same purpose may be substituted for the specific embodiment shown. This application is intended to cover any adaptations or variations of the present invention. For example, in another embodiment shaft 106 is locked in place within housing 108 prior to taking a measurement. Further, other techniques can be used to determine the distance that each tuning member is driven into the plate of the cavity filter.

What is claimed is:

1. A tool for tuning a cavity filter, the tool comprising:

a shaft assembly having a tip, the tip adapted to selectively engage tuning members in plates of cavity filters to adjust and monitor the position of tuning members;

a positional measuring unit, responsive to the shaft, that is adopted to determine positional data for a tuning member;

a data base for storing positional data of a reference tuning member in a tuned filter;

a controller, coupled to the data base, the positional measuring unit and the shaft assembly;

wherein the controller determines the position of the reference tuning member in the tuned filter based on measurements from the positional measuring unit for storage in the data base; and wherein the controller controls the position of tuning members in an un-tuned filter based on positional data in the data base using the shaft assembly.

2. The tool of claim 1, wherein the positional measuring unit comprises one of a digital caliper and a sliding gauge positioned on the shaft.

3. The tool of claim 1, wherein including a spring that is adopted to control translation of the shaft assembly.

4. The tool of claim 1, wherein the shaft includes a screw driver head for adjusting the position of the tuning member and the head rests on the tuning member to monitor the position of the tuning member.

5. The tool of claim 1, wherein the controller controls the position of the tuning members using feedback based on output of the positional measuring unit.

6. The tool of claim 1, wherein the depth measuring unit comprises a caliper with a fixed rail and a measurement head, the measurement head being coupled to the shaft assembly and being adapted to slide along the rail in response to movement of the shaft assembly.

7. The tool of claim 6, wherein the shaft assembly includes a shaft and a motor coupled to the shaft, and further including:

a housing with an opening in one end, the shaft adapted to extend through the opening;

wherein the rail of the caliper is fixedly coupled to the housing; and a spring coupled to the housing and adapted to assert a force on the shaft and motor in the direction of the opening in the end of the housing.

8. A tool for tuning a filter, the tool comprising:

a housing having an opening in an end of the housing;

a shaft, disposed in the housing, the shaft adapted to extend through the opening in the housing;

a motor, coupled to the shaft;

a block, coupled to the motor, wherein the shaft extends from the block through the opening;

a positional measuring unit including a measurement head coupled to the block and a rail coupled to the housing, the positional measuring unit being adapted to determine positional data for a tuning member;

a spring, coupled to the housing and the block, that is adapted to bias the block, shaft and motor in the housing;

a data base for storing positional data for the plurality of tuning members;

a controller, coupled to the data base, the positional measuring unit and the motor;

wherein the controller controls the position of tuning members in an un-tuned filter based on positional data in the data base using the shaft.

9. A tool for tuning a cavity filter, the tool comprising:

a shaft assembly having a tip, the tip adapted to selectively engage tuning members in plates of cavity filters to adjust and monitor the position of the tuning members;

a positional measuring unit, responsive to the shaft assembly, that is adapted to determine positional data for a tuning member;

a data base for storing positional data for a reference tuning member in a tuned filter;

a controller, coupled to the data base, the positional measuring unit and the shaft assembly; and wherein the controller controls the position of timing members in an un-tuned filter based on positional data in the data base and positional data from the positional measuring unit using the shaft assembly.

10. The tool of claim 9, wherein the positional measuring unit comprises one of a digital caliper and a sliding gauge positioned on the shaft.

11. The tool of claim 9, further including a spring that is adapted to control translation of the shaft assembly.

12. The tool of claim 9, wherein the shaft includes a screw driver head for adjusting the position of the tuning member and the head rests on the tuning member to monitor the position of the tuning member.

13. The tool of claim 9, wherein the controller controls the position of the tuning members using feedback based on output of the positional measuring unit.

14. The tool of claim 9, wherein the measuring unit comprises a caliper with a fixed rail and a measurement head, the measurement head being coupled to the shaft assembly and being adapted to slide along the rail in response to movement of the shaft assembly.

15. The tool of claim 14, wherein the shaft assembly includes a shaft and a motor coupled to the shaft, and further including:

a housing with an opening in one end, the shaft adapted to extend through the opening;

wherein the rail of the caliper is fixedly coupled to the housing, and a spring coupled to the housing and adapted to assert a force on the shaft and motor in the direction of the opening in the end of the housing.

16. A tool for pre-tuning a cavity filter, the tool comprising:

a shaft assembly having a tip, the tip adapted to selectively engage a plurality of tuning screws to adjust and monitor the position of the tuning screws;

a housing with an opening in one end, the shaft assembly adapted to extend through the opening;

at least one spring adapted to bias the shaft assembly out of the opening towards the tuning screws;

a gauge, coupled to the shaft assembly, adapted to determine a displacement associated with the tuning screws; and a controller, coupled to drive the shaft assembly based on feedback from the gauge, such that the shaft assembly drives each tuning screw to a selected depth in the plate of the cavity filter.

17. The tool of claim 16, wherein the controller includes a database that includes a depth associated with each tuning screw of the cavity filter.

18. The tool of claim 16, wherein the gauge comprises a digital caliper.

19. The tool of claim 16, wherein the shaft assembly includes a screw driver head for engaging the tuning screws.

20. The tool of claim 16, wherein the gauge comprises a caliper with a fixed rail and a measurement head, the measurement head being coupled to the shaft assembly and being adapted to slide along the rail in response to movement of the shaft assembly.

21. The tool of claim 20, wherein the shaft assembly includes a shaft and a motor coupled to the shaft, and further including:

wherein the rail of the caliper is fixedly coupled to the housing; and a spring coupled to the housing and adapted to assert a force on the shaft and motor in the direction of the opening in the end of the housing.

22. The tool of claim 16, further including a spring that is adapted to control translation of the shaft assembly.

23. A method for tuning a cavity filter having a plurality of tuning members, the method comprising:

selecting a stored set of positional values for the tuning members in a tuning tool;

selectively engaging the tuning members with the tuning tool;

driving the tuning members of the cavity filter to the stored set of positional values with the tuning tool; and further adjusting the position of the tuning members as necessary to achieve a desired frequency response for the cavity filter with the tuning tool.

24. The method of claim 23, wherein selecting a stored set of positional values comprises reading a set of depth values stored in a data base with one depth value for each tuning member in the cavity filter.

25. The method of claim 23, and further including monitoring the frequency response of the cavity filter prior to further adjusting the position of the tuning members.

26. The method of claim 23, wherein driving the tuning members comprises driving each tuning member with a shaft based on positional measurements of the tuning member until a selected position is achieved.

27. The method of claim 23, wherein driving the tuning members comprises driving the timing members of an assembled cavity filter without monitoring the frequency response of the cavity filter.

28. The method of claim 23, wherein further adjusting the position of the tuning members includes monitoring the frequency response of the cavity filter.

29. A method for tuning a plurality of cavity filters each having a plurality of tuning members, the method comprising:

selectively engaging a plurality of tuning members in tuned reference cavity filters;

measuring positional values for the plurality of tuning members in the tuned, reference cavity filters;

storing the positional values in a database as a set of positional values;

selecting a stored set of positional values;

driving tuning members in a cavity filter to the stored set of positional values; and further adjusting the position of the tuning members of the cavity filter as necessary to achieve a desired frequency response.

30. The method of claim 29, wherein selecting a stored set of positional values comprises reading a set of depth values stored in the data base with one depth value for each tuning member in the cavity filter.

31. The method of claim 29, and further including monitoring the frequency response of the cavity filter prior to further adjusting the position of the tuning members.

32. The method of claim 29, wherein driving the tuning members comprises driving each tuning member with a shaft based on positional measurements of the tuning member until a selected position is achieved.

33. The method of claim 29, wherein driving the tuning members comprises driving the tuning members of an assembled cavity filter without monitoring the frequency response of the cavity filter.

34. The method of claim 29, wherein further adjusting the position of the tuning members includes monitoring the frequency response of the cavity filter.

* * * * *